United States Patent [19]

Provest et al.

[11] Patent Number: 4,920,763

[45] Date of Patent: May 1, 1990

[54] CHILLING APPARATUS

[75] Inventors: Phillip B. Provest, 54 Congdon Way, Booragoon, Western Australia, Australia, 6154; David J. Van Dal, 383 Marmion Street, Milville, Western Australia, Australia, 6156

[73] Assignees: Phillip B. Provest, Booragoon; David J. Van Dal, Melville; Kenneth C. Abbott, Trigg; Roland Misteli, Pearcedale, all of Australia

[21] Appl. No.: 241,985

[22] PCT Filed: Oct. 23, 1987

[86] PCT No.: PCT/AU87/00361

§ 371 Date: Jul. 14, 1988

§ 102(e) Date: Jul. 14, 1988

[87] PCT Pub. No.: WO88/03251

PCT Pub. Date: May 5, 1988

[30] Foreign Application Priority Data

Oct. 23, 1986 [AU] Australia ..... PH8654

[51] Int. Cl.[5] ..... F25D 25/00

[52] U.S. Cl. ..... 62/378

[58] Field of Search ..... 62/378, 3, 62, 374

[56] References Cited

U.S. PATENT DOCUMENTS

| | | | |
|---|---|---|---|
| 1,846,219 | 2/1932 | Loosley . | |
| 2,059,700 | 11/1936 | Loosley . | |
| 2,061,427 | 11/1936 | King . | |
| 2,087,117 | 7/1937 | Rezos | 62/378 X |
| 2,355,793 | 8/1944 | Fyock . | |
| 2,422,350 | 6/1947 | Gross . | |
| 2,427,869 | 9/1947 | McMichael . | |
| 2,518,764 | 8/1950 | Dunlap | 62/378 X |
| 2,525,243 | 10/1950 | Shelley . | |
| 2,706,895 | 4/1955 | Thompson . | |
| 2,790,378 | 4/1957 | Zander . | |
| 2,992,316 | 7/1961 | Baumstein . | |
| 3,782,133 | 1/1974 | Desperier et al. | 62/381 |
| 4,388,814 | 6/1983 | Schilling | 62/62 |
| 4,453,385 | 6/1984 | May | 62/3 |
| 4,599,871 | 7/1986 | Fredrixon | 62/378 |

FOREIGN PATENT DOCUMENTS

| | | | |
|---|---|---|---|
| 100675 | 4/1937 | Australia . | |
| 47155/85 | 3/1986 | Australia . | |
| 61309 | 5/1891 | Fed. Rep. of Germany . | |
| 285521 | 2/1914 | Fed. Rep. of Germany . | |
| 655370 | 4/1929 | France | 62/378 |
| 1537821 | 1/1979 | United Kingdom . | |

*Primary Examiner*—Lloyd L. King

*Attorney, Agent, or Firm*—Cushman, Darby & Cushman

[57] ABSTRACT

A vessel containing a refrigerated liquid is provided with a plurality of support platforms which can be elevated and depressed for immersing items to be chilled and then raising them for use. The support platforms may be the upper ends of pressurized fluid-operated vertically extensible and retractable bellows. The operating fluid for the bellows may be the refrigerated liquid in the vessel. The vessel may include an apertured plate through which the items are lowered and raised, with the apertures being perimetrically provided with wipers for wiping liquid from the sides of the items as the items are raised on the platforms after being chilled by immersion in the refrigerated liquid.

7 Claims, 1 Drawing Sheet

CHILLING APPARATUS

BACKGROUND OF THE INVENTION

The present invention relates to a chilling apparatus. In certain circumstances it is desirable to be able to chill containers of food or liquid rapidly. For example, in restaurants, especially where customers supply their own drinks, a rapid chilling apparatus would avoid the problem of having tepid wine or beer served with the meal. The present invention relates to an apparatus for use in rapid chilling of containers of food or drink especially the latter.

SUMMARY OF THE INVENTION

The object of the invention is to provide an effective unit whereby commodities can be effectively chilled.

The invention comprises a chilling apparatus in which a body of cooled liquid is adapted to have a commodity to be cooled immersed therein for a selected period and/or to a selected temperature and is then withdrawn, characterised by a vessel to contain the chilling liquid, refrigeration means to lower the temperature of the chilling liquid to the selected value, a support platform to receive and cause at least part immersion of the commodity to be chilled, and means to elevate the support platform when the required chilling has been effected.

In accordance with one aspect of the present invention there is provided an apparatus for rapid chilling of food or drink containers which comprises a housing arranged to contain a quantity of coolant liquid, means within the housing on which drink, food or dish containers can be rested whilst being at least partially immersed in the coolant liquid, a cooling member located within the housing connected to a refrigeration unit, a liquid pump in communication with the liquid coolant by means of a liquid coolant inlet and a liquid coolant outlet disposed on opposite sides of the cooling member such that in use coolant liquid is circulated by the pump between the inlet and the outlet and passes about the cooling member.

BRIEF DESCRIPTION OF THE DRAWINGS

The present invention will now be described, by way of example, with reference to the accompanying drawings, in which.

DETAILED DESCRIPTION

Figure 1:
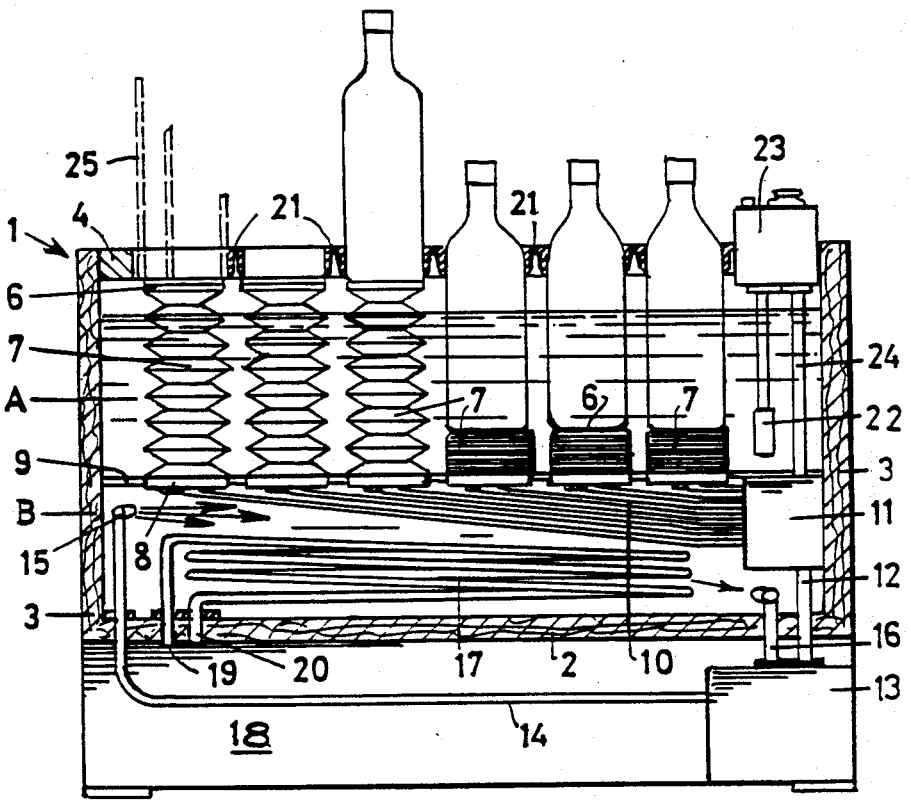
FIG. 1 is a schematic longitudinal vertical section through an apparatus for rapid chilling in accordance with the present invention.
Figure 2:
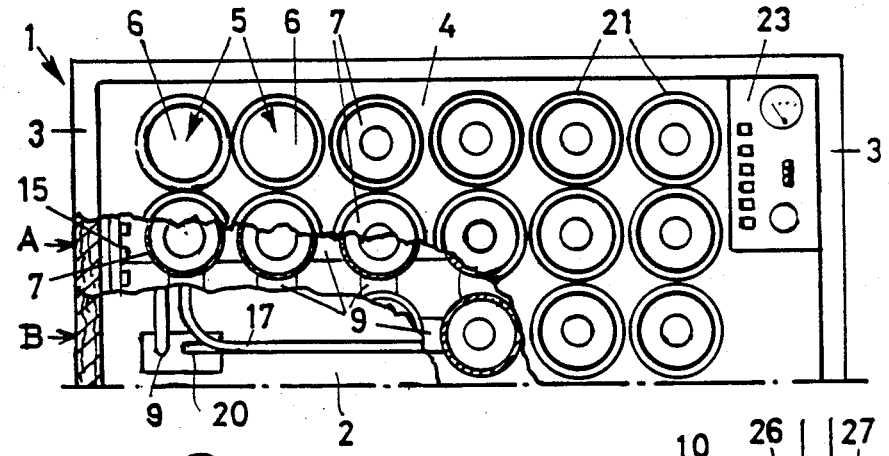
FIG. 2 is a plan view of part of the apparatus of FIG. 1 but sectioned on two lower planes designated A and B in FIG. 1 indicated by similar references in FIG. 2. In the form of the device shown in the drawings the device is arranged as a chilling apparatus which is intended for rapid chilling of containers of food or drink, especially drink in bottles.

A thermally insulated vessel 1 has a base 2 and upstanding outer walls 3 disposed around the periphery of the base 2. The vessel 1 is arranged to contain a quantity of coolant liquid which is typically water or a water based solution.

The vessel 1 is provided with a cover 4 having a plurality of spaced apertures 5 each arranged to receive a commodity to be chilled so that the commodity can be mounted on a platform 6 into which for instance a bottle of drink such as a wine bottle can be placed.

The platform 6, of which there is one for each commodity to be chilled at any one time, is mounted on an elevating device 7 in the form of a fluid operated bellows which is mounted on a base 8 on a grid 9 disposed across the vessel 1, each base 8 being in communication through a fluid line 10 with valve means 11 which is in communication through a fluid line 12 with a fluid pump 13 in this case a liquid pump connected with the coolant liquid space in the housing 1. There is preferably an elevating device 7 for each aperture 5 in the cover 4, and the valve chamber contains the required number of valves to control the multiplicity of elevating devices but sections could be coupled to a single control valve.

The valves, which can take any usual or approved form, operate to allow fluid to draw from the elevating devices 7 when a commodity is placed on its platform 6 to lower the commodity into the chilling fluid but is pressurised when the commodity is to be raised after the required chilling period.

The fluid pump 13 acts also as a fluid circulating device and is in communication through a pipe 14 which leads upwardly through the base 2 to a horizontal discharge pipe 15 having a number of spaced outlet apertures. The fluid pump 13 may be a special subzero fluid handling pump and is in communication with a second pipe 16 which passes upwardly through the base 2 and opens into the end opposite the end of the vessel 1. The discharge pipe 15 is located at a higher level in the vessel 1 than the second pipe 16 which returns the circulating liquid to the pump. A cooling coil 17 is located in the lower part of the vessel 1.

The cooling coil 17 is in communication with a refrigeration unit 18 by means of pipes 19 and 20 and the cooling coil 17 form a cooling circuit. The refrigeration unit 18 may be of known type. The cooling coil 17 is preferably sloped as shown in the drawings, the angling of the coil assisting in contacting of the liquid with the coil, but this is aided also by the forced circulation of the cooling fluid by the fluid pump 13.

The coolant liquid can be any suitable liquid but is has been found that some salts and water and glycol or other organic solutions are synergistic for this purpose.

The spaced apertures 5 may have rubber or similar surrounds 21 or liquid absorbent felt material to dry a container which is snugly received in the aperture 5 as it is removed from the chilling liquid.

In use, the refrigeration unit 18 is energised so as to supply refrigerant to the coil 17 in known manner, and the fluid pump 13 is energised so as to feed coolant liquid into the pipe 14, to the discharge pipe 15 and through the vessel 1 to the pipe 16 where it flows to the pump 13 to be recirculated. In its flow the liquid passes across the lower part of the vessel 1 and contacts the cooling coil 17, causing the coolant liquid to be maintained at the required chilling temperature.

The coolant liquid can be directed upwardly from the horizontal discharge pipe 15 to flow around the commodities held on the platforms 6.

The grid 9 may be in a form of a mesh or apertured sheet, so as to allow circulation of coolant liquid between the lower part of the compartment formed by the housing and the upper part thereof.

In some cases the grid 9 may be replaced by a solid member so that the upper and lower parts of the compartment formed by the housing 1 are completely separated and the upper compartment is cooled by conduction only. Preferably, the rate of cooling of the containers is controlled by the rate of flow of liquid in the lower part of the compartment. Too fast a rate can lead to an excessive drop in temperature and breakage of glass bottles. Too slow a rate can lead to containers still being tepid when it is desired to consume the contents. The rate of flow may be varied in dependence of the type of coolant used.

A timing and/or thermal sensing device to ensure that the commodity is re-elevated at an acceptable contents temperature and cannot be immersed in the chilling liquid for the time required to freeze the contents is provided, and this can comprise the sensor 22 connected to a mini computer 23 coupled electrically by the cable 24 to the valve chamber 11, the system being arranged to either sense the temperature of the liquid coolant and adjust the time of immersion of the commodity or a simple timing mechanism can be used.

The grid 9 may be arranged to be adjusted in height so that varying sizes of containers can be rested on the platforms 6 whilst projecting through the apertures 5.

The valves need not be connected to a pressure supply as shown as when using a spring or other upward loading device the valve may communicate with the atmosphere so that when closed it holds the platform 6 down by sealing the bellows but when the valve is opened the platform would move up under a controlled speed due to controlled inflow of air.

Figure 3:
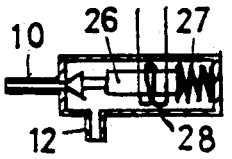
FIG. 3 is a schematic view of a valve as may be used to control the platform elevation.

Such a valve is illustrated schematically in FIG. 3 where the valve comprises a plunger 26 urged into a closed position by a spring 27 and opened by a solenoid 28.

It will be realised that variations such as would be apparent to one skilled in the art are deemed within the scope of the present invention, and it is to be appreciated that the timing arrangement for immersion of the commodities in the chilling liquid can take any usual or approved form such as feeding to the mini-computer data indicating that a commodity has been placed on to a selected platform 6 and timing is to commence, and by relating the time period to the temperature of the liquid coolant, the mini-computer will actuate the appropriate valve in the valve means 11 to pressurize the elevating device 7 to discharge the commodity. Each elevating device 7 could be internally spring loaded so that pressure on the commodity would be required to move the platform down, and the valve or a catch could then be utilized to hold the platform down until the mini computer or a timing device or a temperature sensor releases the valve or catch to elevate the platform and the commodity.

Instead of using a wiper such as is formed by the rubber surrounds 21, the commodity may be placed into an impervious bag before being placed on to the platform 6, and if required the platform 6 can have cage members 25, shown dotted in FIG. 1, between which the commodity can be placed.

I claim:

1. Apparatus for chilling at least one item of a commodity by immersion in a body of chilling liquid, comprising:

a bottom and sidewalls defining a vessel for containing a body of chilling liquid;

a refrigeration means for removing heat from the body of chilling liquid in said vessel;

sensing and control means operatively connected with the refrigeration means, for monitoring temperature in said body of chilling liquid and operating the refrigeration means to maintain the temperature of the body of chilling liquid below a selected temperature;

platform means for supporting at least one item of a commodity relative to said vessel means for moving said platform means between an elevated location at which an item of a commodity may be placed thereon and retrieved therefrom outside the body of chilling liquid, and a depressed location at which an item of a commodity which has been placed on said platform means is substantially immersed in the body of chilling liquid;

said vessel further including a top wall having a plurality of horizontally spaced apertures therethrough;

said platform means including a respective platform underlying each said aperture; and said means for moving said platform means including means permitting each said platform to be moved from the elevated location thereof to the depressed location thereof upon placement of a respective said item thereon, and means for moving each depressed said platform from the depressed location thereof to the elevated location thereof upon attainment by the item supported on such platform of a selected extent of chilling.

2. The apparatus of claim 1, wherein:

the means for moving said platform means includes:

a vertically extensible and retractable bellows having a fixed lower end and a movable upper end for supporting a respective item thereon;

a pump means; and valved conduit means connecting said pump means with said bellows, whereby said bellows may be individually extended and retracted for elevating and immersing respective said items in respect to said body of chilling liquid.

3. The apparatus of claim 2, wherein:

said vessel contains a body of chilling liquid and said pump means includes an inlet for drawing chilling liquid into said pump as a working fluid for extending said bellows.

4. The apparatus of claim 3, wherein:

said pump means further includes inlet and outlet means for circulating said chilling liquid in said vessel.

5. The apparatus of claim 2, wherein:

each said aperture is provided about the perimeter thereof with a wiper for wiping a chilled item as a respective depressed platform is elevated so as to elevate therethrough a chilled item supported on a respective said platform.

6. The apparatus of claim 2, wherein:

at least one said bellows has said upper end thereof provided with an upwardly projecting outer peripheral cage for laterally supporting an item when supported on the upper end of said bellows.

7. The apparatus of claim 2, wherein:

said valved conduit means comprises:

a plurality of conduits connecting individual ones of said bellows with said pump means; and a solenoid-operated valve for each said conduit.

* * * * *